US005755583A

United States Patent [19]

McCarthy

[11] Patent Number: 5,755,583

[45] Date of Patent: May 26, 1998

[54] MODULAR ELECTRICAL CONNECTOR SYSTEM

[76] Inventor: David G. McCarthy, 59 Applewood Dr., Huntington, Conn. 06484

[21] Appl. No.: 77,206

[22] Filed: Jun. 14, 1993

[51] Int. Cl.[6] ..... H01R 25/16

[52] U.S. Cl. ..... 439/215

[58] Field of Search ..... 439/207–216

[56] References Cited

U.S. PATENT DOCUMENTS

| | | | |
|---|---|---|---|
| 4,313,646 | 2/1982 | Millhimes et al. | 439/215 |
| 4,775,328 | 10/1988 | McCarthy | 439/211 |
| 5,046,963 | 9/1991 | Kelly | 439/215 |
| 5,092,787 | 3/1992 | Wise et al. | 439/215 |

OTHER PUBLICATIONS

Electro–Pak Systems; Advertising Brochure, Electri–Cable Assemblies, Inc., Orange, CT.; 1992.

Electri–Pak 8; Advertising Brochure, Electri–Cable Assemblies, Inc., Orange CT.

*Primary Examiner*—Neil Abrams

*Attorney, Agent, or Firm*—Mark P. Stone

[57] ABSTRACT

A modular electrical power block assembly has sixteen separate electrical conductors divided equally into two separate halves of the total assembly. The two half sections are electrically isolated from each other in a single housing. Each half of the assembly contains three live electrical conductors, three neutral electrical conductors, and two ground electrical conductors for forming three different electrical circuits. The input end of each half section of the power block is separately electrically coupled to a different electrical power feed for energizing the live electrical conductors in each half section of the power block to provide a total of six separate electrical circuits for the entire power block. The output end of each half of the modular electrical power block can be electrically coupled to either the input of a separate power block module for providing three additional electrical circuits in close proximity to the six circuit modular electrical power block, or the output of each half section of the six circuit modular electrical power block can be electrically coupled to the input of one half section of a similar six circuit modular electrical power block. Each modular power block in the system has ports for removably receiving individual circuit modules for selectively connecting predetermined circuits within the power block by electrically engaging preselected conductors within the power block.

19 Claims, 3 Drawing Sheets

MODULAR ELECTRICAL CONNECTOR SYSTEM

BACKGROUND OF THE INVENTION

Electrical connector systems including modular power blocks defining ports for removably receiving individual circuit modules are generally known to the art. U.S. Pat. No. 4,775,328, entitled "Modular Seven Wire Electrical Connector System", issued on Oct. 4, 1988 to the present inventor, discloses a seven wire system including a modular electrical power block and a plurality of individual circuit modules removably received within ports of the power block to selectively complete different circuits defined by electrical conductors within the power block. Modular electrical power systems are also disclosed in a brochure entitled "Electri-Pak Systems", copyright 1992, published by Electri-Cable Assemblies, Inc., the Assignee of the aforementioned U.S. Pat. No. 4,775,328. This publication illustrates an eight wire modular electrical connector system providing both three and four separate electrical circuits. A similar publication entitled "Electri-Pak 8", published by Electri-Cable Assemblies, Inc. in 1991, further discloses an eight wire modular power block for providing either three or four circuits for an electrical connector system of the type discussed above.

Although the known electrical connector and distribution systems serve useful purposes, three and four circuit systems may nonetheless fail to provide adequate electrical power in areas where electrical requirements warrant maximum electrical power. It is therefore a primary object of the present invention to provide a modular electrical connector and distribution system for providing maximum electrical power in preselected areas where such power requirements are warranted. It is a further object of the present invention to provide an electrical connector system in which a primary modular power block is arranged to provide maximum electrical power at a preselected location, and a secondary power block having lesser electrical power capacity is electrically coupled to only one portion of the primary modular power block to meet the additional lesser electrical power requirements at a location proximate to the primary modular power block. It is still a further object of the present invention to provide a modular electrical connector and distribution system having a plurality of power block modules of different maximum electrical capacities which are electrically coupled to each other for selectively controlling and varying the electrical power to be provided at different locations within the system. Other objects and advantages of the present invention will become apparent from the following discussion in conjunction with the accompanying drawings.

SUMMARY OF THE INVENTION

An electrical connector and distribution system includes a modular electrical power block defining a plurality of ports for removably receiving electrical circuit modules. The power block comprises two separate half sections joined together as a single unit in a single housing and separated by an electrical isolation barrier provided within the housing. The modular power block includes sixteen electrical conductors comprising six circuit (live) wires, six neutral conductors, and four ground conductors for providing six different electrical circuits. Each half section of the modular power block provides three separate electrical circuits consisting of a first circuit having separate live, neutral and ground conductors; and two additional circuits having separate live and neutral electrical conductors, but sharing a common ground. An input end of each section half of the power module is separately coupled to a source of electrical energy by a separate electrical feeder so as to selectively and separately energize one or both half section of the power module, as may be desired by the user. The output end of each half section of the modular electrical power block may itself be electrically coupled to the input end of either a separate secondary three circuit modular power block having correspondingly arranged electrical conductors, or to the input end of one half section of a similar six circuit modular electrical power block. The different modular power blocks coupled to each other in the overall distribution system are energized by a common electrical source.

The electrical connector and distribution system provided by the present invention supplies maximum power (six separate electrical circuits) to preselected areas within the system in which such power requirement is warranted. Moreover, the system enables one or both half sections of the six circuit power module to be electrically coupled to one or two secondary power modules having lesser power requirements (e.g., providing three electrical circuits) in preselected locations proximate to the primary modular electrical power block to provide differing electrical power capacities at different locations within the system. In the alternative, each half section of the six circuit modular power block can be separately electrically coupled to corresponding half sections of another six circuit modular power block. Accordingly, the electrical power distribution system provided by the present invention is versatile for selectively meeting the varying power requirements at different preselected locations within the overall system.

DETAILED DISCUSSION OF THE BEST MODES FOR CARRYING OUT THE INVENTION

Figure 1A:
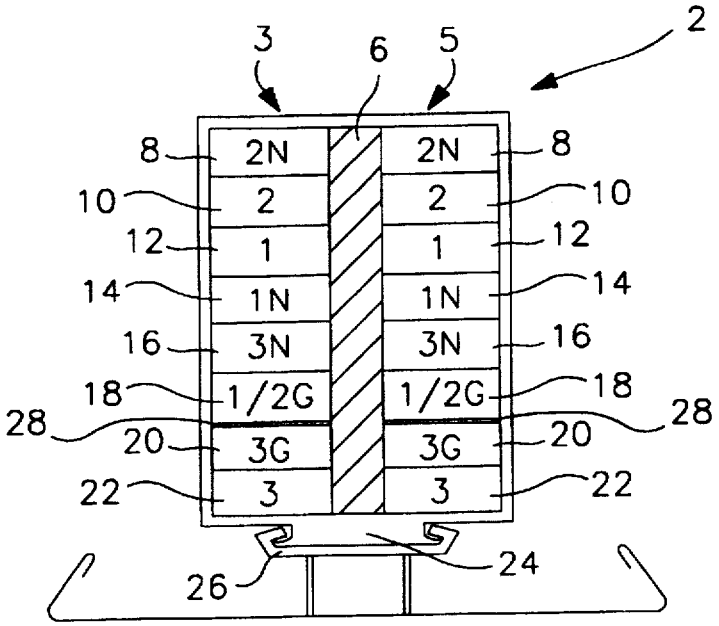
FIGS. 1A and 1B of the drawing illustrate, in section, an arrangement of sixteen electrical conductors for providing six separate circuits within a single modular power block housing, in accordance with the present invention.

The present invention will now be described in greater detail with reference being made to FIGS. 1–3 of the drawing. U.S. Pat. No. 4,775,328, entitled "Modular Seven Wire Electrical Connector System, issued on Oct. 4, 1988, is expressly incorporated by reference into the present specification. The disclosures of publications entitled "Electri-Pak Systems" (copyright 1992, EPS No. 0392), published by Electric-Cable Assemblies, Inc.; and "Electric-Pak 8", published by Electri-Cable Assemblies, Inc., are also expressly incorporated by reference into the present specification.

FIG. 1A of the drawing illustrates, in section, a modular electrical power block 2 in accordance with the present invention. The power block is of the general type disclosed in the aforementioned U.S. Pat. No. 4,775,328, and includes ports for removably receiving separate circuit modules, as for example, circuit module 4 illustrated in FIG. 3 of the drawing. Attention is directed to U.S. Pat. No. 4,775,328 and the aforementioned two publications for a further discussion of the general nature of modular electrical power blocks of the general type which define ports for removably receiving separate circuit modules for selectively electrically connecting predetermined electrical circuits within the modular power block.

Referring back to FIG. 1A, the power block of the present invention includes sixteen electrical conductors which are symmetrically disposed on opposed sides of an electrical isolation barrier 6 for defining two separate and identically arranged half electrical sections 3 and 5 within the single housing defining the modular power block 2. Each of the two half electrical sections comprises a neutral conductor 8 adjacent to a live conductor 10 which is adjacent to a different live conductor 12 which is adjacent to a different neutral conductor 14 which is adjacent to a different neutral conductor 16 which is adjacent to a ground conductor 18 which is adjacent to a different ground conductor 20 which is adjacent to a different live conductor 22. Each of the two half electrical sections of the power block 2 is defined on opposite sides of the centrally disposed isolation barrier 6 to provide three separate circuits in each half section consisting of a first circuit formed from live conductor 22, ground conductor 20, and neutral conductor 16; and two separate circuits which share a common ground conductor 18, and are otherwise respectively formed from live conductor 10 and neutral conductor 8, and live conductor 12 and neutral conductor 14. Accordingly, the power block 2 provides six separate electrical circuits defined from sixteen electrical conductors in which one circuit in each half section of the power block defined on each side of the isolation barrier 6 is formed from separate live, neutral and ground conductors, while the remaining two circuits on each side of the isolation barrier 6 share common ground conductors but include separate live and neutral electrical conductors.

Figure 1B:
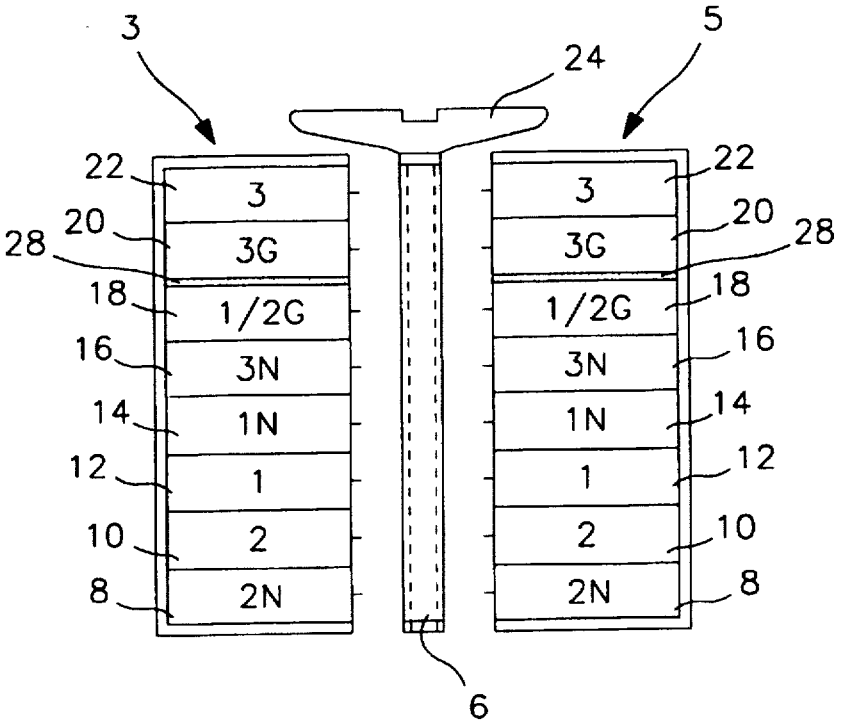

In the embodiment of the invention illustrated in FIG. 1A, the isolation barrier 6 extends from a mounting head 24 which is received within a complementary configured mounting bracket 26 disposed at the bottom end of the power block 2. FIG. 1B illustrates the same power block of FIG. 1A except that the two different electrical half sections 3 and 5 are shown separated from the isolation barrier 6 for illustrative purposes. Additionally, the orientation of the power block 2, as illustrated in FIG. 1B, is 180° reversed from that illustrated in FIG. 1A so that the power block of FIG. 1B will be mounted by the mounting head 24 in a mounting bracket (not shown in FIG. 1B) which is orientated above the power block 2, and not below the power block 2 as illustrated in FIG. 1A.

The two separate electrical half sections of the power block module 2 are secured to the centrally extending electrical isolation barrier 6 by means of heat staking and sonic welding for forming a single unitary power block assembly comprising the two separate electrical half sections 3 and 5 having the identical orientation of electrical conductors which are symmetrically arranged on opposed sides of the isolation barrier. The entire six circuit system is preferably rated at 20 amps per circuit, and the individual circuit modules (e.g., module 4 illustrated 4n FIG. 3) are preferably NEMA 5–15R receptacles and are rated at 15 amperes/125 volts. The electrical circuit in each half section 3 and 5 of the power block 2 formed from the separate live conductor 22, the separate ground conductor 20 and the separate neutral conductor 16 are shielded by a shield 28 to prevent the transmission of electromagnetic interference from the remaining two circuits, respectively, within each half section of the power module.

Each receptable or circuit module 4 received within each port defined in the power block includes appropriate mechanical means for assuring that the circuit module can only be received within the port in a predetermined orientation for completing a predetermined electrical circuit. As illustrated in the aforementioned publication entitled "Electri-Pak Systems", each circuit module includes an interference pin extending from the rear surface of the circuit module together with the electrical contacts, and the port defined in the power module includes receiving means for the interference pin to prevent the pin from being received within the port unless the circuit module is received in the port in it s proper orientation. Reference is made to the aforementioned publications and to U.S. Pat. No. 4,775,328, which are each incorporated herein by reference, for a more detailed discussion of the manner in which each circuit module includes extending electrical contacts which complete only preselected circuits when the circuit module is received within any port defined in the power block.

Figure 2:
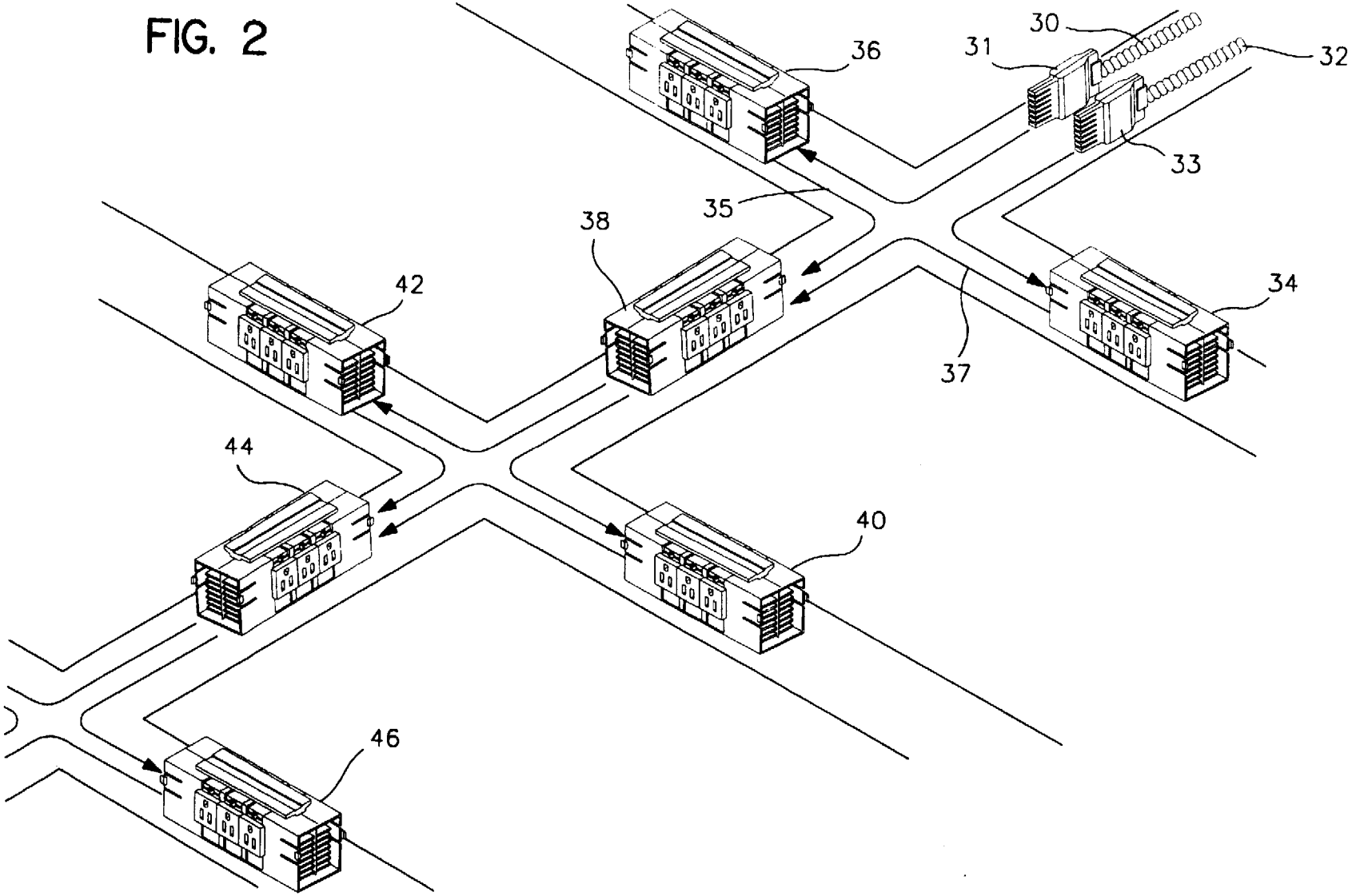
FIG. 2 of the drawing schematically illustrates an electrical connector and distribution system in accordance with the present invention including both primary and secondary modular power blocks electrically coupled to each other.

FIG. 2 of the drawing illustrates an electrical connector system in which a plurality of modular power blocks are electrically coupled to each other. Two power supply cables 30 and 32 are coupled to electrical feeders 31 and 33, respectively. Feeder 31 is electrically coupled to a power block 36, while feeder 33 is electrically coupled to a power block 34. Both power blocks 34 and 36 are eight conductor, three circuit power modules (described as the "System 83" in the two aforementioned publications incorporated herein by reference) and in which the eight conductors are oriented to identically correspond to the eight conductors of each electrical half section of the power block 2 illustrated and discussed with respect to FIGS. 1A and 1B. The power modules 40, 42 and 46 are also three circuit, eight wire electrical power block modules identical to each of the power block modules 34 and 36. The power block modules 38 and 44 are each sixteen wire, six circuit units, each of which corresponds identically in electrical conductor content, arrangement and orientation to that of power block module 2 discussed with respect to FIGS. 1A and 1B. One of the electrical half sections of power block 38 is energized from the output of power block 36 (which itself is energized from the power cable 30 and electrical feeder 31) by an electrical connector 35. Similarly, the other electrical half section of power block 38 is energized from the output of power block 34 (which itself is energized from electrical power cable 32 and electrical feeder 33) through an electrical connector 37. The outputs of each of the two electrical half sections of power block 38 are electrically connected to one of the eight wire, three circuit power blocks 40 and 42, respectively. The outputs of power blocks 40 and 42 are illustrated as each being electrically connected to a different electrical half section of a sixteen wire, six circuit power block module 44. Accordingly, the overall electrical connector system illustrated by FIG. 2 includes a plurality of sixteen wire, six circuit modular electrical power blocks selectively electrically interconnected to a plurality of eight wire, three circuit modular electrical power blocks. The entire system is fed by two separate electrical power cables 30 and 32 from a common electrical source (not shown in the drawing). As an alternative to the arrangement illustrated by FIG. 2, the output of each of the two electrical half sections of the six circuit power module 38 can be directly connected to the input of each of two electrical half sections of the other, six circuit modular power block 44. Accordingly, the arrangement and interconnection of the modular electrical power blocks is variable at the selection of the user to provide different electrical power capacity at different predetermined locations within the overall electrical distribution system, depending upon the power requirements of the system at specific locations therein.

The electrical power block assemblies and the electrical connector and electrical feed elements of the system illustrated by FIG. 2 of the drawing include mechanical means for preventing insertion of the electrical feed element into the modular power blocks unless the conductors in the feed elements are properly aligned and orientated to engage the appropriate corresponding conductors in the modular power block in which the connector is to be inserted. In this manner, each of the live circuit conductors in a power block engaging an electric feeder or connector is properly energized by the electrical power source.

Figure 3:
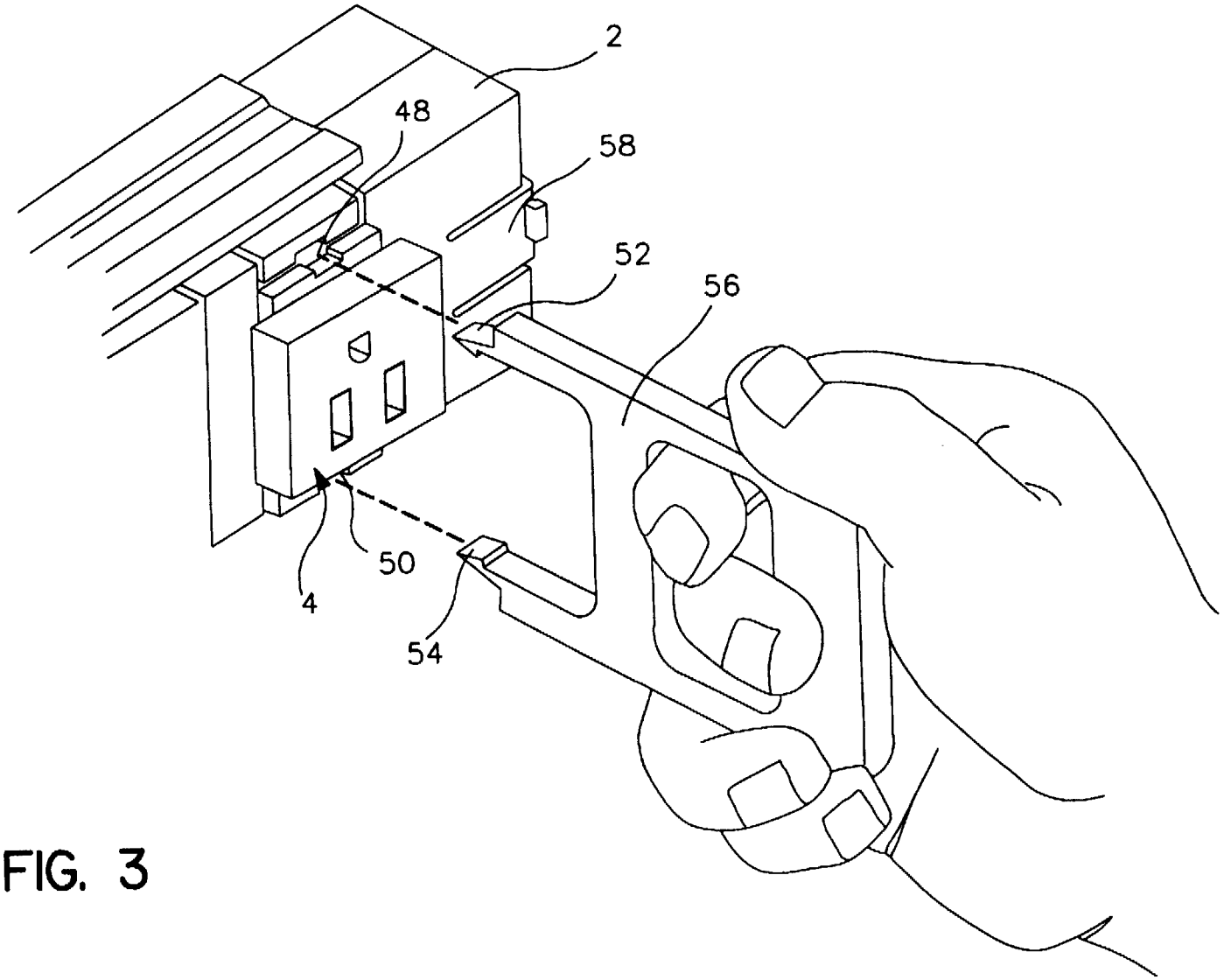
FIG. 3 of the drawing illustrates a perspective view of a modular circuit element removably received within a port defined in a power block in accordance with the present invention, and further illustrates a tool for selectively removing the circuit module from the port.

FIG. 3 of the drawing illustrates a single circuit module 4 received within a port defined in the power block 2. Cut-out portions 48 and 50 are defined on the top and bottom of the circuit module 4 for engaging a latch mechanism in the modular power block 2. Upper and lower prongs 52 and 54 of a tool 56 are received in the upper and lower cut-out section 48 and 50, respectively, for removing the circuit module 4 from the port in the power block 2 in which the circuit module is received. The removal of the circuit module by use of the removal tool is discussed more fully in U.S. Pat. No. 4,775,328. The modular power block 2 also includes a latch element 58 integrally defined on a side of the housing for engaging a corresponding locking element defined on the electrical feeders 31 and 33 and similar locking elements on electrical connectors 35 and 37 for releasably locking the feeders or connectors into the input and output ends of the power blocks. In this manner, the electrical feeders and connectors cannot be accidentally or unintentionally disengaged from the modular power blocks in which the connectors and feeders are received.

It is apparent from the above discussion that the system of the present invention defines electrical connector and distribution elements for providing different capacities of electrical power at pre-selected locations within the system, depending upon the actual or anticipated electrical requirements at said locations. Maximum electrical power is provided by six circuit, sixteen wire modular power blocks, which may be coupled directly to other similar six circuit units or, at the selection of the user, to less powerful three circuit units. The system of the present invention is versatile and adjustable to meet varying electrical power requirements at different locations because the six circuit, sixteen wire power modules are formed from two identical electrical half sections, each of which corresponds identically to the orientation and arrangement of the electrical conductors in the secondary three circuit, eight wire modular electrical power blocks. The overall system can be formed by directly connecting separate six circuit power blocks to each other, and/or interconnecting half sections of one or more six circuit power blocks to less powerful three circuit power blocks. The system may be arranged to provide predetermined selections of electrical power capacity at pre-selected locations, but may also be readily adjusted to meet varying power needs by re-arrangement of the initial layout of the system.

Other advantages and modifications to the systems described herein within the scope of the present invention will become apparent to those skilled in the art. Accordingly, the description of the preferred embodiments of the invention discussed above is intended to be illustrative only and not restrictive of the scope of the invention, that scope being defined by the following claims and all equivalents thereto.

I claim:

1. An electrical distribution system comprising a first modular power block including a first housing and a plurality of electrical conductors in said first housing, said first housing defining a plurality of ports for removably receiving separate circuit modules for selectively connecting predetermined conductors within said first housing for completing predetermined electrical circuits, said first modular power block providing at least six electrical circuits;

a second modular power block comprising a housing, and a plurality of electrical conductors in said second housing said second housing defining a plurality of ports for removably receiving a plurality of circuit modules for engaging predetermined electrical conductors in said second housing for completing preselected electrical circuits; said second modular power block providing at least three separate electrical circuits;

means for electrically connecting said first modular power block to said second modular power block;

wherein at least sixteen electrical conductors are within said first housing, said electrical conductors defining two separate sections separated by an electrical isolation barrier, said two separate sections defining the identical arrangement and number of electrical conductors disposed on opposed sides of said electrical isolation barrier.

2. The system as claimed in claim 1 wherein said electrical isolation barrier is substantially centrally disposed in said first housing and said arrangement of electrical conductors in each of said sections is symmetrically disposed on opposed sides of said electrical isolation barrier.

3. The system as claimed in claim 2 wherein said electrical isolation barrier comprises mounting means for mounting said first housing to a predetermined location in said electrical distribution system.

4. The system as claimed in claim 1 wherein the electrical conductors in said second housing are defined and arranged to correspond identically to said arrangement of electrical conductors in each of said two separate sections defined in said first housing.

5. The system as claimed in claim 4 wherein each of said two electrical sections defined in said first housing and defined in said second housing include eight electrical conductors comprising three live circuit conductors, three neutral conductors, and two ground conductors.

6. The system as claimed in claim 5 wherein said eight electrical conductors provide three separate electrical circuits comprising a first circuit having a separate live conductor, a separate neutral conductor and a separate ground conductor; a second circuit comprising a separate live conductor, a separate neutral conductor and a ground conductor; and a third circuit comprising a separate live conductor, a separate neutral conductor and a ground conductor commonly shared with said second circuit.

7. The system claimed in claim 6 further including means for shielding said first circuit from said second and third circuits.

8. The system as claimed in claim 6 wherein said eight electrical conductors are arranged such that the live conductor for said first circuit is adjacent to the ground conductor for said first circuit, which is adjacent to the shared ground for said first and second circuits, which is adjacent to said neutral conductor for said first circuit, which is adjacent to a neutral conductor for one of said second and third circuits, which is adjacent to the live conductor for said one of second and third circuits, which is adjacent to the live conductor for the other of the second and third circuits, which is adjacent to the neutral conductor for the other of said second and third circuits.

9. The system as claimed in claim 1 wherein said electrical isolation barrier disposed between said two electrical sections of said first housing is welded to said housing.

10. The system as claimed in claim 1 further including two separate electrical connector means for supplying electrical power to each of said two different electrical sections defined in said first housing.

11. The system as claimed in claim 10 including two separate electrical connector elements, one of said electrical connector elements electrically connecting the output end of one of said electrical sections of said first housing to the input end of a second housing having electrical conductors identical in arrangement and number to said one electrical section of of said first housing.

12. The system as claimed in claim 11 wherein a second electrical connector electrically connects the output end of said other section of said first housing with the input end of a third housing having electrical conductors corresponding identically in number and arrangement to that in said second housing and said other section of said first housing.

13. The system as claimed in claim 1 further including two separate electrical connector means for connecting the output end of each of said two electrical sections defined in said first housing to the inputs of two of said second housings comprising an arrangement of electrical conductors identical to that of each of said sections of said first housing.

14. An electrical distribution system comprising a first modular power block including a first housing and a plurality of electrical conductors in said first housing, said first housing defining a Plurality of ports for removably receiving separate circuit modules for selectively connecting predetermined conductors within said first housing for completing predetermined electrical circuits, said first modular power block providing at least six electrical circuits;

a second modular power block comprising a housing and a plurality of electrical conductors in said second housing, said second housing defining a plurality of ports for removably receiving a plurality of circuit modules for engaging predetermined electrical conductors in said second housing for completing preselected electrical circuits; said second modular power block providing at least three separate electrical circuits;

means for electrically connecting said first modular power block to said second modular power block;

wherein one of said first and second housings includes at least one port defined in said housing and being adapted to removably receive a circuit module therein, and a plurality of electrical conductors within said housing, said circuit module received in said port connecting a predetermined number of said electrical conductors to complete a predetermined electrical circuit, said housing including an electrical isolation barrier for separating said electrical conductors in said housing into two electrical sections having corresponding electrical conductors arranged in parallel columns separated by said isolation barrier, each of said two housing sections having an input end and an output end to enable electrical engagement of said electrical conductors in each of said two housing sections for selectively completing one or more electrical circuits.

15. The system as claimed in claim 14 wherein said plurality of electrical conductors include at least 16 electrical conductors for forming at least 6 electrical circuits, said electrical conductors including six live conductors, six neutral conductors, and 4 ground conductors.

16. The system as claimed in claim 15 wherein said at least 16 electrical conductors form two electrical circuits having two separate live conductors, two separate ground conductors, and two separate neutral conductors; and four electrical circuits each having separate live and neutral conductors but sharing a common ground conductor with one other electrical circuit.

17. The system as claimed in claim 16 wherein one of said circuits including separate live, neutral and ground conductors, and two of said circuits having a common ground conductor are disposed within each of said two sections defined in said housing.

18. The system as claimed in claim 16 further including means for shielding each of said two electrical circuits formed from separate live, neutral ground conductors from electromagnetic interference from said other four electrical circuits.

19. The system as claimed in claim 1 wherein said electrical conductors in said first housing consist of six live conductors, six neutral conductors, and four ground conductors for providing six electrical circuits consisting of: two electrical circuits formed from two live conductors, two ground conductors, and two neutral conductors; and four electrical circuits formed from four live conductors, four neutral conductors, and two ground conductors in which each of said four circuits shares a common ground conductor with one other of said four circuits.

* * * * *